US009008535B2

(12) United States Patent
Wakayama et al.

(10) Patent No.: US 9,008,535 B2
(45) Date of Patent: Apr. 14, 2015

(54) IMAGE FORMING APPARATUS HAVING MECHANISM FOR PREVENTING CONDENSATION FROM CONTACTING A SHEET

(71) Applicant: Konica Minolta, Inc., Chiyoda-ku (JP)

(72) Inventors: Masahide Wakayama, Toyokawa (JP); Naoichi Asakura, Shinshiro (JP); Yasuaki Tomoda, Toyohashi (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 128 days.

(21) Appl. No.: 13/862,802

(22) Filed: Apr. 15, 2013

(65) Prior Publication Data

US 2013/0272744 A1 Oct. 17, 2013

(30) Foreign Application Priority Data

Apr. 16, 2012 (JP) ..... 2012-092870

(51) Int. Cl.
*G03G 21/20* (2006.01)

(52) U.S. Cl.
CPC ..... *G03G 21/203* (2013.01)

(58) Field of Classification Search
USPC ..... 399/91, 92, 97, 320
See application file for complete search history.

(56) References Cited

U.S. PATENT DOCUMENTS

| | | | | |
|---|---|---|---|---|
| 8,165,490 | B2 * | 4/2012 | Yamazoe | 399/92 |
| 8,509,646 | B2 * | 8/2013 | Shimizu | 399/92 |

FOREIGN PATENT DOCUMENTS

| | | | |
|---|---|---|---|
| JP | 5-035135 | A | 2/1993 |
| JP | 09-016005 | A | 1/1997 |
| JP | 2006-276215 | A | 10/2006 |
| JP | 2006-322994 | A | 11/2006 |
| JP | 2007-304161 | A | 11/2007 |
| JP | 2009-134207 | A | 6/2009 |
| JP | 2011-095569 | A | 5/2011 |

OTHER PUBLICATIONS

Office Action (Notification of Reasons for Refusal) issued on Jul. 22, 2014, by the Japanese Patent Office in corresponding Japanese Patent Application No. 2012-092870 and an English translation of the Office Action. (5 pages).

* cited by examiner

*Primary Examiner* — William J Royer
(74) *Attorney, Agent, or Firm* — Buchanan Ingersoll & Rooney PC

(57) ABSTRACT

An image forming apparatus including: a fixing unit including a heating rotational body, and configured to perform heat-fixing by putting a sheet having an unfixed-image formed thereon in contact with the heating rotational body; and a mechanism including a plate-like water droplet guiding member and a condensation collection container, and configured to receive water droplets at an upper surface of the water droplet guiding member, guide the water droplets towards the condensation collection container, and collect the water droplets at the condensation collection container, the water droplets generated above the fixing unit by condensation of water vapor that rises from the sheet during the heat-fixing and falling therefrom. When viewing the image forming apparatus from above in a vertical direction, the condensation collection container is disposed outside a sheet passing region in a sheet width direction.

12 Claims, 8 Drawing Sheets

IMAGE FORMING APPARATUS HAVING MECHANISM FOR PREVENTING CONDENSATION FROM CONTACTING A SHEET

CROSS-REFERENCE TO RELATED APPLICATIONS

This application is based on application No. 2012-092870 filed in Japan, the content of which is hereby incorporated by reference.

BACKGROUND OF THE INVENTION (1) Field of the Invention

The present invention relates to an image forming apparatus, and in particular, to a technology of preventing water droplets generated by condensation, in the image forming apparatus, of water vapor generated at a fixing unit from contacting a sheet.

(2) Description of the Related Art

An image forming apparatus such as a printer and a copier is commonly provided with a fixing unit for heat-fixing a toner image onto a recording sheet (hereinafter referred to simply as a "sheet").

A fixing unit in a common image forming apparatus applies heat to a sheet to perform heat-fixing. When heat is applied to a sheet, moisture contained in the sheet is discharged, which results in the generation of water vapor. When water vapor is generated in such a manner at the fixing unit, the water vapor rises upwards in the image forming apparatus and condenses at an inner surface of an outer cover of the image forming apparatus. When condensation of water vapor takes place at the inner surface of the outer cover, there is a risk of the water vapor dropping onto a sheet being conveyed in the image forming apparatus in the form of water droplets. This leads to problems such as the formation of creases in the sheet and the decrease in quality of an image printed on the sheet.

In view of such problems, a proposal is being made of an image forming apparatus that prevents water droplets from dropping onto a sheet by being provided with a mechanism for receiving water droplets falling downwards from an inner surface of an outer cover of the image forming apparatus. More specifically, such a mechanism is disposed with respect to a guide member that is located relatively higher (hereinafter referred to as an upper guide member) among a pair of guide members forming a sheet conveyance path in the image forming apparatus.

For instance, Japanese Patent Application Publication 2006-322994 discloses a structure (a mechanism for collecting water droplets) where the upper guide member includes: a water droplet collection container (a water droplet accumulation portion) that is located above a sheet passing region; and a plate-like water droplet guiding member (a water droplet-receiving plate portion) that receives water droplets dropping thereon from the inner surface of the outer cover and guides the water droplets to the water droplet collection container. The water droplets collected by the water droplet collection container evaporate naturally, and are discharged to the outside of the image forming apparatus.

Further, Japanese Patent Application Publication No. 5-35135 discloses a fixing device having an upper cover that is provided with a water droplet reception/accumulation portion. The water droplet reception/accumulation portion is composed of a water droplet receiver that receives water droplets generated on an inner surface of the upper cover and a water droplet accumulator that accumulates the water droplets received by the water droplet receiver. Further, the upper cover is provided with a shape for guiding the water droplets towards the water droplet reception/accumulation portion.

In addition, Japanese Patent Application Publication No. 2007-304161 discloses a cooling device that includes a fixing device, a cooling portion, and a moisture transporting means. The cooling portion is arranged so as to be in contact with or in close proximity to the fixing device. Further, the surface of the cooling portion is water repellent, and moisture attaching to the surface of the cooling portion is transported to a predetermined location by the moisture transporting means.

However, in a conventional image forming apparatus provided with a water droplet collection container (i.e., a water droplet reception/accumulation portion), there is a risk of water droplets overflowing from the water droplet collection container in the worst-possible case. Here, the worst-possible case refers to, for instance, a case where continuous printing of an enormous number of sheets is performed. When an enormous number of sheets are continuously printed, the amount of water vapor generated at the fixing unit increases. This further results in the amount of water droplets collected by the water droplet collection container increasing and possibly exceeding the amount of water droplets naturally evaporating from the water droplet collection container, which leads to water droplets overflowing from the water droplet collection container. In such a case as described above, the water droplets flowing out from the water droplet collection container may drop onto a sheet being conveyed in the image forming apparatus. This gives rise to problems such as the formation of creases in the sheet and the decrease in quality of an image printed on the sheet

SUMMARY OF THE INVENTION

In view of such problems, the present invention provides an image forming apparatus that prevents water droplets from dropping onto a sheet even when water droplets overflow from a water droplet collection container. As such, the image forming apparatus pertaining to the present invention prevents problems such as the formation of creases in the sheet and the decrease in quality of an image printed on the sheet from occurring.

More specifically, the image forming apparatus pertaining to the present invention comprises: a fixing unit comprising a heating rotational body, and configured to perform heat-fixing by putting a sheet having an unfixed-image formed thereon in contact with the heating rotational body; and a mechanism comprising a plate-like water droplet guiding member and a condensation collection container, and configured to receive water droplets at an upper surface of the water droplet guiding member, guide the water droplets towards the condensation collection container, and collect the water droplets at the condensation collection container, the water droplets generated above the fixing unit by condensation of water vapor that rises from the sheet during the heat-fixing and falling therefrom, wherein when viewing the image forming apparatus from above in a vertical direction, the condensation collection container is disposed outside a sheet passing region in a sheet width direction, the sheet passing region being a region that the sheet passes when being conveyed and the sheet width direction being perpendicular to a direction in which the sheet is conveyed.

BRIEF DESCRIPTION OF THE DRAWINGS

These and other objects, advantages, and features of the invention will become apparent from the following description thereof taken in conjunction with the accompanying drawings that illustrate a specific embodiment of the invention.

In the drawings.

DESCRIPTION OF PREFERRED EMBODIMENTS

Embodiment 1

In the following, description is provided of embodiment 1 of the image forming apparatus pertaining to the present invention, with reference to the accompanying drawings. Note that the following description is based on an example of a monochrome printer (referred to hereinafter simply as a "printer").

(1) Overall Structure of Printer

Figure 1:
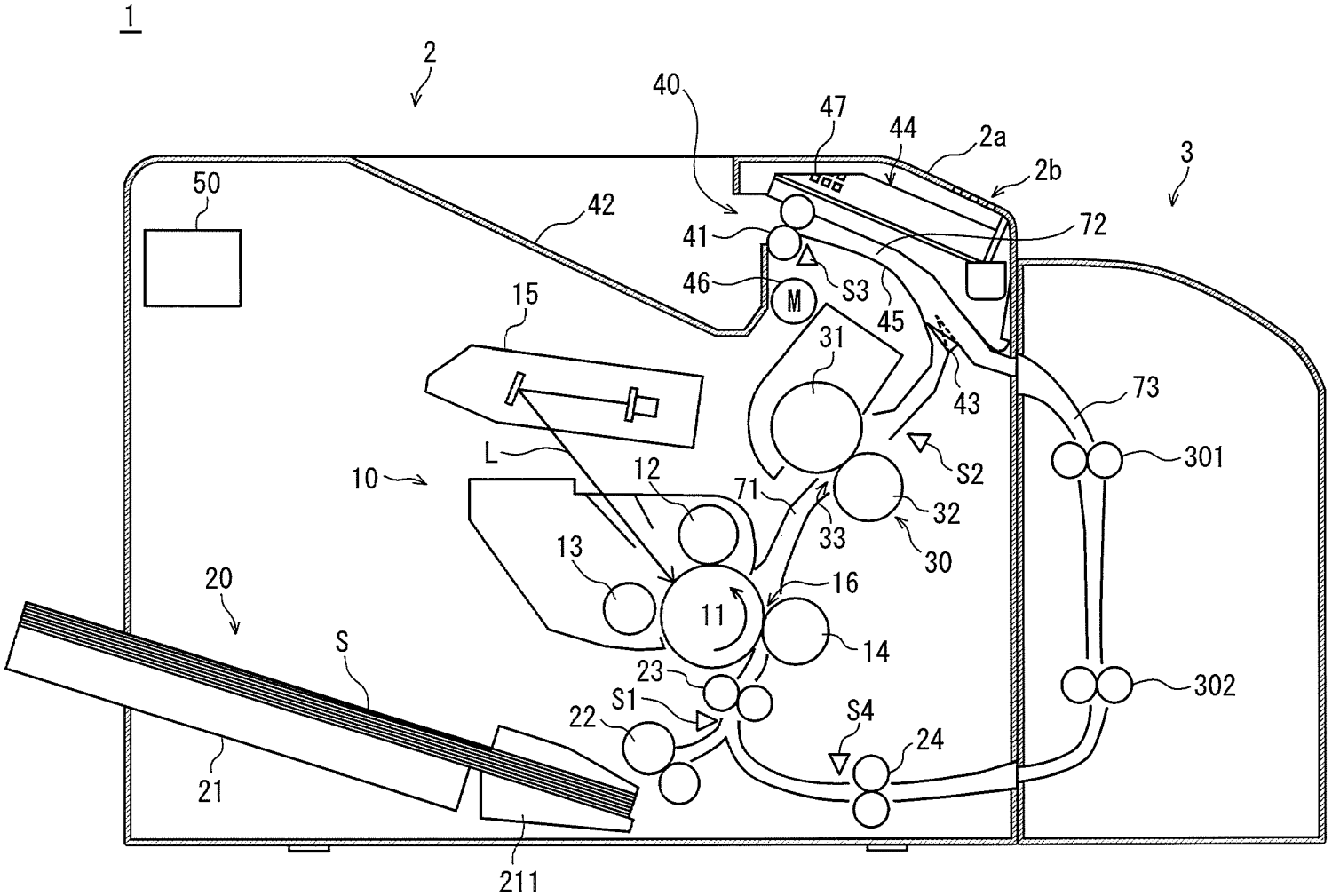
FIG. 1 illustrates an overall structure of a printer pertaining to embodiment 1 of the present invention.

FIG. 1 illustrates an overall structure of a printer 1 pertaining to the present embodiment.

As illustrated in FIG. 1, the printer 1 includes a main body unit 2 and an option unit 3 attached to the main body unit 2 in an attachable/detachable state. The main body unit 2 includes: an image processor 10; a paper feeder 20; a fixing unit 30; a discharge sheet reversing unit 40; and a control unit 50. The option unit 3 is provided to realize duplex printing, and hence, is referred to hereinafter as a "duplex printing unit 3". The printer 1 is connected to a network (e.g., a LAN). When receiving an instruction from an external terminal device (undepicted) for executing a print-job, the printer 1, according to the instruction, forms a monochrome toner image and executes printing processing of printing the toner image on a sheet S.

The image processor 10 includes: a photosensitive drum 11; a charger 12; a developer 13; a transfer roller 14; and an exposure unit 15. The charger 12, the developer 13, the transfer roller 14, and the exposure unit 15 are disposed around the photosensitive drum 11 as illustrated in FIG. 1.

The photosensitive drum 11 is driven to rotate in a direction indicated by the arrow illustrated in FIG. 1. The charger 12 charges the photosensitive drum 11 such that a predetermined electric potential is uniformly applied to an entire outer circumferential surface of the photosensitive drum 11. The exposure unit 15 exposure-scans the charged outer circumferential surface of the photosensitive drum 11 and thereby forms an electrostatic latent image on the outer circumferential surface of the photosensitive drum 11. The exposure unit 15 includes light-emitting elements such as laser diode elements. Upon receiving a drive signal from the control unit 50, the exposure unit 15 emits a laser beam L. The drive signal is generated by the control unit 50 in accordance with print-target image data.

The electrostatic latent image formed on the photosensitive drum 11 is developed by the developer 13, which results in a toner image being formed on the photosensitive drum 11.

At the timing at which the toner image is formed on the photosensitive drum 11, the sheet S is fed from the paper feeder 20.

The paper feeder 20 includes: a sheet holding tray 21; a sheet feeding roller pair 22; and a resist roller pair 23. The sheet feeding roller pair 22 picks up the sheet S on the sheet holding tray 21 and supplies the sheet S. Note that here, the sheet feeding roller pair 22 picks up sheets on the sheet holding tray 21 one by one. The resist roller pair 23 adjusts the timing at which the sheet S is fed to a transfer nip 16 formed between the photosensitive drum 11 and the transfer roller 14. Further, the sheet holding tray 21 is provided with an ascending/descending plate 211 that ascends/descends and thereby adjusts the height of a front end portion of the sheet S. More specifically, as a result of the ascending/descending of the ascending/descending plate 211, the front end portion of the sheet S arrives at a height at which the sheet feeding roller pair 22 is capable of picking up the sheet S by the front end portion.

The toner image on the photosensitive drum 11 is transferred onto the sheet S when the sheet S passes through the transfer nip 16. The transferring of the toner image occurs due to a transfer electric field being formed by a transfer voltage applied to the transfer roller 14.

The sheet S having the toner image transferred thereon is removed from the photosensitive drum 11 by an undepicted separation claw and then, is conveyed to the fixing unit 30. Note that in the following, a conveyance path from the sheet feeding roller pair 22 to the fixing unit 30 is referred to as a "sheet feeding path 71".

Following the transfer of the toner image onto the sheet S, residual toner on the surface of the photosensitive drum 11 is removed by an undepicted cleaner, and further, residual charge on the surface of the photosensitive drum 11 is removed by an undepicted eraser.

The fixing unit 30 includes a heating roller 31 and a pressurizing roller 32 that form a fixing nip 33. The sheet S having the toner image transferred thereon, by being inserted into the fixing nip 33, is heated while being pressurized. This results in the toner image being heat-fixed onto the sheet S. The heating roller 31 includes a heat generator such as a halogen heater. The control unit 50 controls on/off of the heat generator, whereby the temperature on the surface of the heating roller 31 is kept at a fixing temperature. Here, it should be noted that the method according to which the fixing unit 30 is heated is not limited to the above-described method of using a heater. That is, the heating of the fixing unit 30 may be performed by utilizing electromagnetic induction or by using a resistance heating element.

The sheet S having the toner image fixed thereon is conveyed to the discharge sheet reversing unit 40.

The discharge sheet reversing unit 40 includes: a sheet discharge roller pair 41; a sheet discharge tray 42; and a switching claw 43. Note that in the following, a conveyance path from the fixing nip 33 to the sheet discharge roller pair 41 is referred to as a "sheet discharge path 72".

The switching claw 43 swings about a pivot, and is thereby configured to be switchable between a first position illustrated by solid lines in FIG. 1 and a second position illustrated by broken lines in FIG. 1. The switching claw 43, when the sheet S is not being conveyed along the sheet discharge path 72 towards the sheet discharge roller pair 41, is configured to be in the first position due to its own weight. In contrast, when the sheet S is conveyed along the sheet discharge path 72 towards the sheet discharge roller pair 41 and passes through the switching claw 43, the switching claw 43 switches to the second position by being pressed upwards by the front end portion of the sheet S. Further, when a rear end portion of the sheet S passes through the switching claw 43, the switching claw 43 returns to the first position, which is the original position thereof, due to its own weight.

The sheet discharge roller pair 41 is caused to rotate in two directions, namely a normal direction and a reverse direction, by a drive motor 46. When printing is performed in the simplex printing mode, the sheet discharge roller pair 41 rotates in the normal direction and discharges the sheet S onto the sheet discharge tray 42. On the other hand, when printing is performed in the duplex printing mode, the sheet discharge roller pair 41 first rotates in the normal direction at least until the rear end portion of the sheet S, which now has an image printed on a front surface (a first surface) thereof, passes through the switching claw 43. Subsequently, the discharge roller pair 41 rotates in the negative direction and thereby switches back the sheet S towards a sheet refeeding path 73 of the duplex printing unit 3.

The duplex printing unit 3 includes sheet refeeding roller pairs 301 and 302. The sheet refeeding roller pairs 301 and 302 convey the sheet S along the sheet refeeding path 73, whereby the sheet S is returned to the sheet feeding path 71 via a sheet refeeding roller pair 24 provided to the main body unit 2. As such, the sheet S is conveyed once again towards the photosensitive drum 11 with a rear surface (a second surface) thereof facing the photosensitive drum 11 this time. At the photosensitive drum 11, a toner image is transferred onto the rear surface of the sheet S, and further, the toner image is heat-fixed onto the rear surface of the sheet S at the fixing nip 33. The sheet S, having an image printed on each surface thereof, is discharged onto the sheet discharge tray 42 from the sheet discharge roller pair 41.

Here, note that the conveyance of sheets in the printer 1 is controlled by the control unit 50 in accordance with output results received from sheet detection sensors. In specific, the sheet detection sensors are conventional sheet detection sensors that detect sheets being conveyed, and are disposed at predetermined positions along the sheet feeding path 71, the sheet discharge path 72, and the sheet refeeding path 73. In FIG. 1, the sheet detection sensors are indicated by the symbols S1 through S4.

The control unit 50, in addition to controlling the conveyance of sheets as described above, also executes the printing processing. As such, the control unit 50 has general control over the image processor 10, the paper feeder 20, the fixing unit 30, the discharge sheet reversing unit 40, and the duplex printing unit 3.

When the printing processing is executed as described above, moisture is discharged from the sheet S being heated by the fixing unit 30. As such, water vapor is generated. So as to discharge the water vapor so generated to the outside of the printer 1, the main body unit 2 is provided with an outer cover 2*a* having an outlet 2*b*. Here, note that the outer cover 2*a* is located above the fixing unit 30. Further, in the main body unit 2, the sheet discharge path 72 is formed by a lower discharge sheet guide 45 and an upper discharge sheet guide 44. The upper discharge sheet guide 44 is located between the fixing unit 30 and the outer cover 2*a* and is provided with a vent 47 for guiding the water vapor generated by the sheet S being heated by the fixing unit 30 towards the outlet 2*b*. Here, note that each of the outlet 2*b* and the vent 47 is constituted of a plurality of holes.

The provision of the outlet 2*b* and the vent 47 results in the water vapor generated by the sheet S being heated by the fixing unit 30 moving as described in the following and as illustrated in the enlarged view of FIG. 2. A large proportion of the water vapor generated at the fixing unit 30 rises upwards in the main body unit 2 along the sheet discharge path 72 (as indicated by the arrow F1 in FIG. 2), passes through the vent 47 provided to the upper discharge sheet guide 44 (as indicated by the arrow F2 in FIG. 2), and is discharged to the outside of the printer 1 via the outlet 2*b* (as indicated by the arrow F3 in FIG. 2).

In addition, in the present embodiment, the upper discharge sheet guide 44 is also provided with a mechanism for receiving and collecting water droplets (indicated by the symbols D in FIG. 2) that are formed by the water vapor generated by the sheet S being heated by the fixing unit 30 condensing by contacting an inner surface (a bottom surface) of the outer cover 2*a*. By receiving and collecting the water droplets D, the mechanism provided to the upper discharge sheet guide 44 prevents the water droplets D from dropping onto the sheet S conveyed along the sheet discharge path 72.

(2) Description of the Mechanism for Collecting Water Droplets

In the following, detailed description is provided of the structure of the upper discharge sheet guide 44, with reference to FIG. 3.

Figure 3:
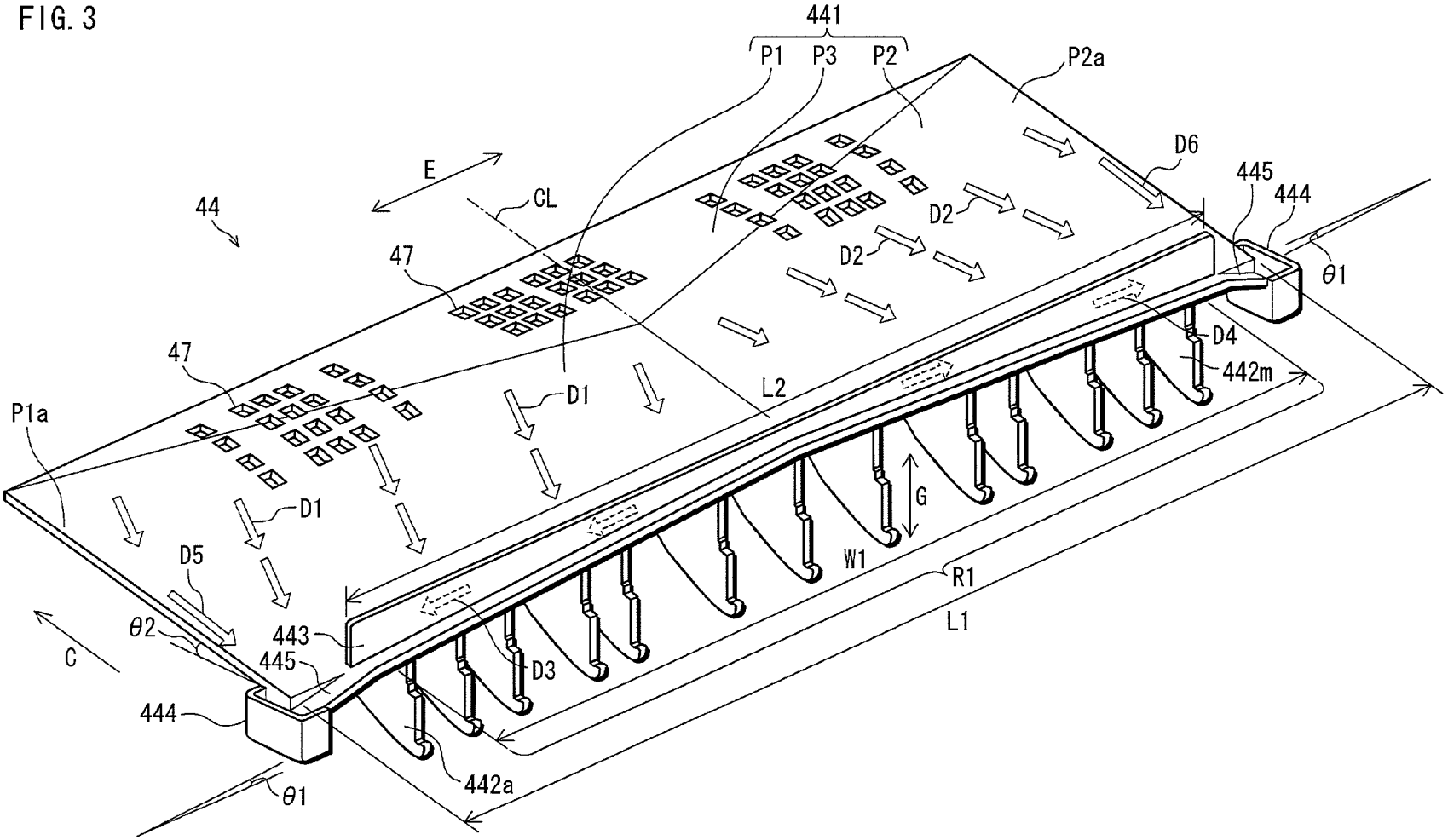
FIG. 3 is a perspective view of an upper paper discharge guide.

FIG. 3 is a perspective view illustrating the upper paper discharge sheet guide 44.

As illustrated in FIG. 3, the upper discharge sheet guide 44 includes: a plate-shaped guide main body 441; guide ribs 442*a* through 442*m*; a water droplet guide rib 443; and one pair of water droplet collection containers 444. The upper discharge sheet guide 44 is formed, for instance, by using a resin material and by integrally molding the guide main body 441, the guide ribs 442*a*-442*m*, the water droplet guide rib 443, and the pair of water droplet collection containers 444. The guide ribs 442*a* through 442*m* are provided to a bottom surface (a rear surface) of the guide main body 441, and the water droplet guide rib 443 is disposed so as to stand on a top surface of the guide main body 441.

Further, the water droplet collection containers 444 are provided to an end portion of the guide main body 441 in an upstream direction of a sheet discharge direction C in FIG. 3 (the end portion referred to hereinafter as "an upstream end portion"). Further, each of the water droplet collection containers 444 is provided at a different one of two ends, in a width direction E in FIG. 3, of the upstream end portion of the guide main body 441. Note that the width direction E indicates the same direction as a width direction of the sheet discharge path 72.

The guide main body 441 is composed of three plate-like portions P1 through P3. Further, the guide main body 441 is provided with a structure as described in the following for guiding water droplets having dropped thereon to the water droplet collection containers 444.

The two plate-like portions P1 and P2 have identical trapezoidal shapes, and are provided so as to be symmetrical with respect to a center line CL in FIG. 3, which is a line passing through a center of the guide main body 441 in the width direction E. Further, each of the two plate-like portions P1 and P2 is inclined towards a corresponding end of the guide main body 441 in the width direction E by an inclination angle Θ1, whereby an inverted V shape is formed by the two plate-like portions P1 and P2. The remaining one of the three plate-like portions P1-P3, or that is, the plate-like portion P3 has the shape of a triangle and shares one different side with each of the plate-like portions P1 and P2.

A length L1 of the guide main body 441 is set to be greater than a maximum width W1 of a sheet passing region R1 which the sheet S passes in the sheet discharge path 72 and the sheet refeeding path 73. To provide a specific example, the length L1 of the guide main body 441 is, for instance, greater than a sheet width of a short edge-fed A3-sized sheet. Further, the water droplet collection containers 444 are provided at respective sheet non-passing regions. The sheet non-passing regions are imaginary regions which the sheet S does not pass and which lie at both sides of the sheet passing region R1 in the width direction E.

The vent 47 is formed at an area of the guide main body 441 lying relatively downstream in the sheet discharge direction C in FIG. 3 (referred to hereinafter as a "downstream area"). The structure of the vent 47 in terms of the shapes, the sizes, the number, and the arrangement of the holes constituting the vent 47 is not limited in any particular way provided that the vent 47, constituted of such holes, is capable of letting the water vapor generated at the fixing unit 30 to pass through such that the water vapor is discharged from the outlet 2*b* of the outer cover 2*a*.

The guide ribs 442*a* through 442*m* are disposed with a predetermined interval between one another in the width direction E. Further, each of the guide ribs 442*a* through 442*m* contacts the sheet S at a bottom end surface thereof and thereby guides the sheet S to the sheet discharge tray 42. As such, the guide ribs 442*a* through 442*m* serve as one part of a sheet conveyance path (a combination of the sheet discharge path 72 and the sheet refeeding path 73). In addition, since the guide main body 441 has an inverted V shape in the present embodiment, adjustment is performed of the guide ribs 442*a* through 442*m* in terms of the amount by which the guide ribs 442*a* through 442*m* protrude from the guide main body 441. That is, the lengths of the guide ribs 442*a* through 442*m* in the direction indicated by the arrow G in FIG. 3 are adjusted so that the bottom end surfaces of the guide ribs 442*a* through 442*m* are level with respect to each other.

The water droplet guide rib 443 is disposed at the upstream end portion of the guide main body 441 and extends in the width direction E. The water droplet guide rib 443, in addition to having the function of preventing water droplets from falling from the upstream end portion of the guide main body 441, has the function of guiding water droplets towards the water droplet collection containers 444.

Further, a length L2 of the water droplet guide rib 443 is set so as to be equal to or greater than the maximum width W1 of the sheet passing region R1 and so as to be equal to or smaller than the length L1 of the guide main body 441. As such, the water droplet guide rib 443 extends so as to overlap the entire sheet passing region R1 in the width direction E. By being configured in such a manner, the water droplet guide rib 443 prevents water droplets from falling onto the sheet S conveyed along the sheet discharge path 72 and the sheet refeeding path 73.

In addition, a portion of the guide main body 441 between each of the water droplet collection containers 444 and the water droplet guide rib 443 is formed to have a steeper inclination compared to other portions of the guide main body 441, and thereby forms a guiding path 445. The guiding paths 445 ensure that water droplets are guided with certainty from the guide main body 441 to the water droplet collection containers 444.

The upper discharge sheet guide 44 having the above-described structure is attached to the inner surface of the outer cover 2*a* via an undepicted attachment member. Here, it should be noted that the upper discharge sheet guide 44 is attached to the inner surface of the outer cover 2*a* such that the guide main body 441 is arranged in an inclined state where the upstream end portion of the guide main body 441 in the sheet discharge direction C is lower than a downstream end portion of the guide main body 441 in the sheet discharge direction C. More specifically, an inclination angle Θ2 in FIG. 3 indicates the inclination of ends P1*a* and P2*a*, which are the two ends of the guide main body 441 in the width direction E, relative to the horizontal direction when the guide main body 441 is arranged in the inclined state as described above. By the guide main body 441 being arranged in the inclined state as described above, an upper surface of each of the plate-like portions P1 and P2 forms an inclined surface whose height decreases as approaching a corner portion thereof at which the corresponding water droplet collection container 444 is provided. As such, water droplets having dropped on the plate-like portions P1 and P2 move towards the corner portions of the plate-like portions P1 and P2 due to their own weight (while some of the water droplets may move along the water droplet guide rib 443) before eventually being guided to and collected at the water droplet collection containers 444 (in FIG. 3, such movement of water droplets are indicated by arrows D1 through D4).

In the present embodiment, a combination of the guide main body 441 and the water droplet guide rib 443 functions as a water droplet guiding member that receives water droplets falling from the inner surface of the outer cover 2*a* and guides the water droplets towards the pair of water droplet collection containers 444. Furthermore, a combination of the guide main body 441, the water droplet guide rib 443, and the pair of water droplet collection containers 444 forms a mechanism for collecting water droplets.

Here, it should be noted that the measures of the inclination angles Θ1 and Θ2, which indicate the inclination of the guide main body 441, are not limited in any particular way. However, since the size of a printer device increases as the inclination angle Θ1 increases, it is desirable that the inclination angle Θ1 be set as small as possible so as to suppress such an increase in device size. On the other hand, the inclination angle Θ2 is to be determined according to design conditions such as the layout of the sheet discharge path 72, and the like, within the device.

In addition, it should be noted that, when the inclination angle Θ1 is inappropriately great, there is a risk of water droplets falling off from the ends P1*a* and P2*a* of the guide main body 441 due to an increase in the speed at which the water droplets move in the width direction E on the guide main body 441. As such, the inclination angle Θ1 is set to be relatively small in the present embodiment so as to suppress the speed at which water droplets move in the width direction E and thereby ensure that water droplets having reached the ends P1*a* and P2*a* move along inclined edges of the ends P1*a* and P2*a* (having an inclination indicated by the inclination angle Θ2) to be guided towards the water droplet collection containers 444 (the movement of such water droplets indicated by arrows D5 and D6 in FIG. 3). The measure of the inclination angle Θ1 in the present embodiment has been calculated through experimentation.

However, even if water droplets were to fall off from the ends P1*a* and P2*a* of the guide main body 441 in the manner as described above, the water droplets having fallen off arrive at the sheet non-passing regions of the sheet S. As such, the above-described problems such as the formation of creases in the sheet S and the decrease in quality of an image printed on the sheet S do not occur. Nevertheless, so as to prevent water droplets from falling and contacting the fixing unit 30 and the image processor 10, it is desirable to set the inclination angle Θ1 as small as possible or to provide additional water droplet guide ribs and/or gutters to the ends P1*a* and P2*a* of the guide main body 441.

Further, the water droplets collected by the water droplet collection containers 444 evaporate naturally, and are discharged to the outside of the printer 1. As for the sizes of the water droplet collection containers 444, it is desirable that the water droplet collection containers 444 be provided so as to have large sizes so as to prevent water droplets from overflowing therefrom even if continuous printing of an enormous number of sheets is performed. However, the degree to which the sizes of the water droplet collection containers 444 can be increased is limited since the overall size of the printer 1 would increase if the water droplet collection containers 444 were provided with such large sizes. Due to such limitation being imposed concerning the sizes of the water droplet collection containers 444, there is a risk of water droplets overflowing from the water droplet collection containers 444 in the worst-possible case. Nevertheless, problems such as the formation of creases in the sheet S and the decrease in quality of an image printed on the sheet S do not occur since the present embodiment ensures that water droplets overflowing from the water droplet collection containers 444 do not fall and contact the sheet S being conveyed. This is since, as already described above, the water droplet collection containers 444 are provided so as to be located above the sheet non-passing regions.

In addition to those described above, the printer 1 pertaining to the present embodiment is provided with the structures as described in the following so as to prevent problems from occurring due to water vapor being generated and water droplets being generated by the condensation of water vapor. In the following, description is provided on such structures while referring to FIG. 2 once again.

Figure 2:
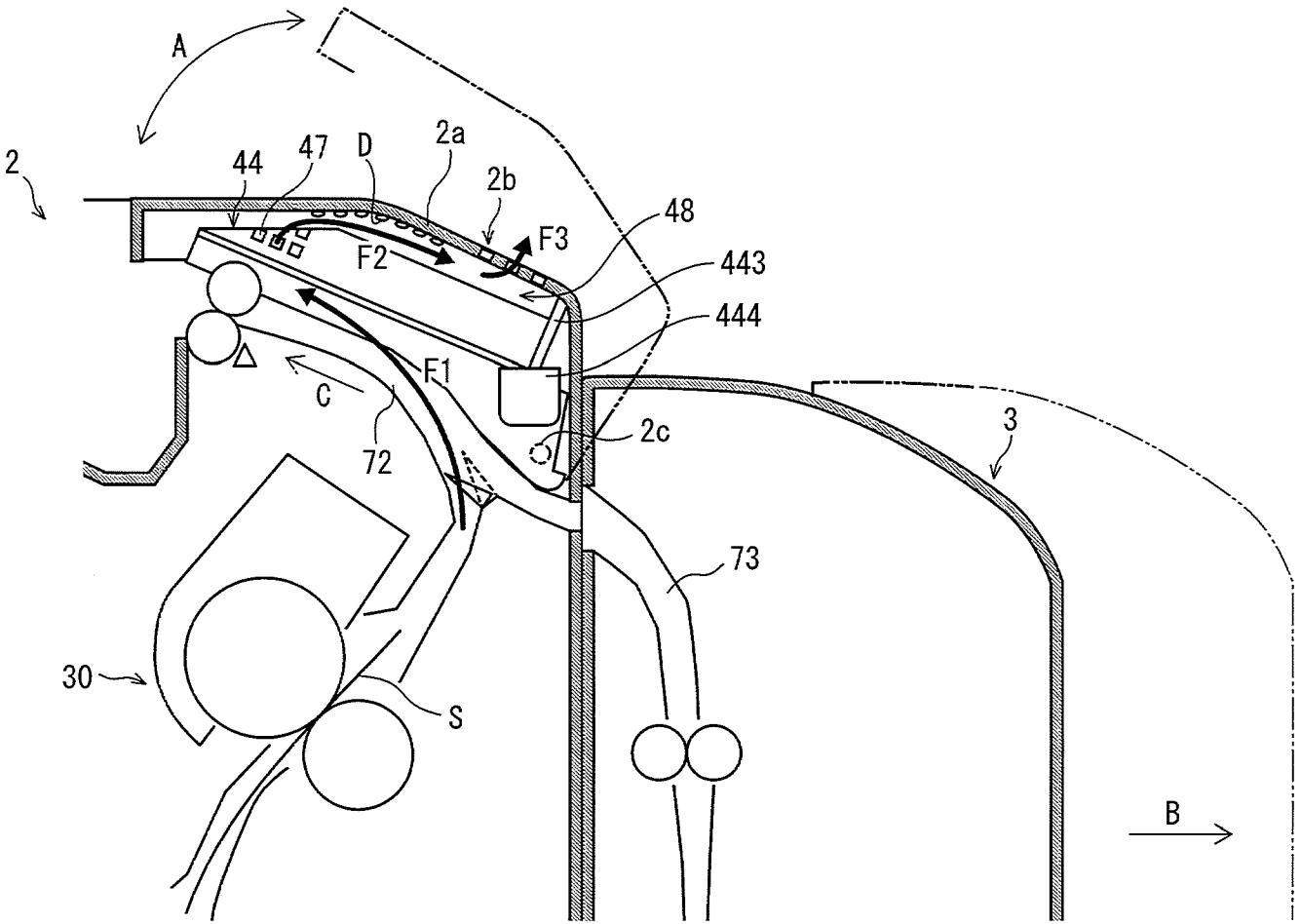
FIG. 2 is an enlarged view of one part of the printer.

First, as illustrated in FIG. 2, an upper end of the water droplet guide rib 443 is put in contact with the inner surface of the outer cover 2*a*. By putting the upper end of the water droplet guide rib 443 in contact with the inner surface of the outer cover 2*a*, water droplets having attached to the inner surface of the outer cover 2*a* are prevented from flowing along the inner surface of the outer cover 2*a* towards a bottom end of the outer cover 2*a* and dropping onto the sheet S conveyed along the sheet refeeding path 73. In addition, the contact between the upper end of the water droplet guide rib 443 and the inner surface of the outer cover 2*a* also functions as a guide that guides water vapor towards the outlet 2*b* by regulating the flow of water vapor.

In addition, as illustrated in FIG. 2, the outlet 2*b* is provided to the outer cover 2*a* such that the outlet 2*b* does not overlap the vent 47 of the upper discharge sheet guide 44 in the vertical direction. By providing the outlet 2*b* to the outer cover 2*a* in such a manner, water vapor is caused to pass through a discharge duct 48 formed between the upper discharge sheet guide 44 and the outer cover 2*a*. As such, particularly when water vapor density within the discharge duct 48 is high, water vapor condenses within the discharge duct 48, which results in dry water vapor being discharged from the outlet 2*b*. By causing dry water vapor to be discharged from the outlet 2*b* by causing the condensation of water vapor to take place within the discharge duct 48, a situation is prevented from occurring where a user of the printer 1 mistakenly thinks that smoke is being discharged from the printer 1. Such a situation can be assumed to occur when a user sees steam generated by water vapor in a high, unreduced density state being directly discharged from the outlet 2*b* and by the high-density water vapor being cooled by outside air.

Further, since the discharge duct 48 provides thermal insulation between the sheet discharge path 72 and the outside air, the cooling and the resultant condensation of water vapor within the sheet discharge path 72 is prevented.

In addition, the outer cover 2*a* overlapping (covering) the upper discharge sheet guide 44 is provided so as to be rotatable in a direction indicated by the arrow A in FIG. 2 about a support shaft 2*c*. The support shaft 2*c* is provided to the main body unit 2 and extends along the width direction E of the guide main body 441. As such, the outer cover 2*a* is configured to be openable/closable when the duplex printing unit 3 is separated from the main body unit 2 by being moved in a direction indicated by the arrow B in FIG. 2. This structure allows the sheet discharge roller pair 41 and the sheet discharge path 72, in the case of jam removal or inspection, to be exposed to the outside when the outer cover 2*a* is opened since the upper discharge sheet guide 44, which is attached to the outer cover 2*a*, also rotates along with the outer cover 2*a* when the outer cover 2*a* is opened. Further, when the outer cover 2*a* is opened and the upper discharge sheet guide 44 passively rotates as described above, the water droplet collection containers 444 are also caused to move. However, since the water droplet collection containers 444 are provided relatively close to the support shaft 2*c* about which the upper discharge sheet guide 44 rotates in the present embodiment, the acceleration rate of the movement of the water droplet collection containers 444 is relatively small compared to a case where the water droplet collection containers 444 are located farther from the support shaft 2*c*. As such, water droplets accumulated inside the water droplet collection containers 444 are prevented from rushing out of the water droplet collection containers 444 when the outer cover 2*a* is opened. If water droplets were to rush out of the water droplet collection containers 444 when opening/closing the outer cover 2*a* as described above, the user who has opened/closed the outer cover 2*a* would be disappointed. Further, when there is such a risk, the user would have to perform the opening/closing of the outer cover 2*a* with much care so as to avoid water droplets from rushing out of the water droplet collection containers 444, which would result in a decrease in usability of the printer 1. So as to prevent such problems from occurring, the water droplet collection containers 444 are provided in close proximity to the support shaft 2*c* in the present embodiment.

Embodiment 2

An upper discharge sheet guide in embodiment 2 differs from the upper discharge sheet guide 44 in embodiment 1 for being provided with a guide main body having the shape of a flat plate, and further, for being provided with a water droplet guide rib having an arched shape (a curved shape).

In addition, as a result of the upper discharge sheet guide in embodiment 2 differing from the upper discharge sheet guide 44 in embodiment 1 as described above, some other structural elements included in the upper discharge sheet guide also slightly differ between embodiments 1 and 2. Since the constituent elements included in a printer pertaining to embodiment 2, other than the upper discharge sheet guide, are basically similar to the corresponding constituent elements included in the printer 1 in embodiment 1, such constituent elements are indicated by using the same reference signs as in embodiment 1 and description of such constituent elements are omitted in the following.

Figure 4:
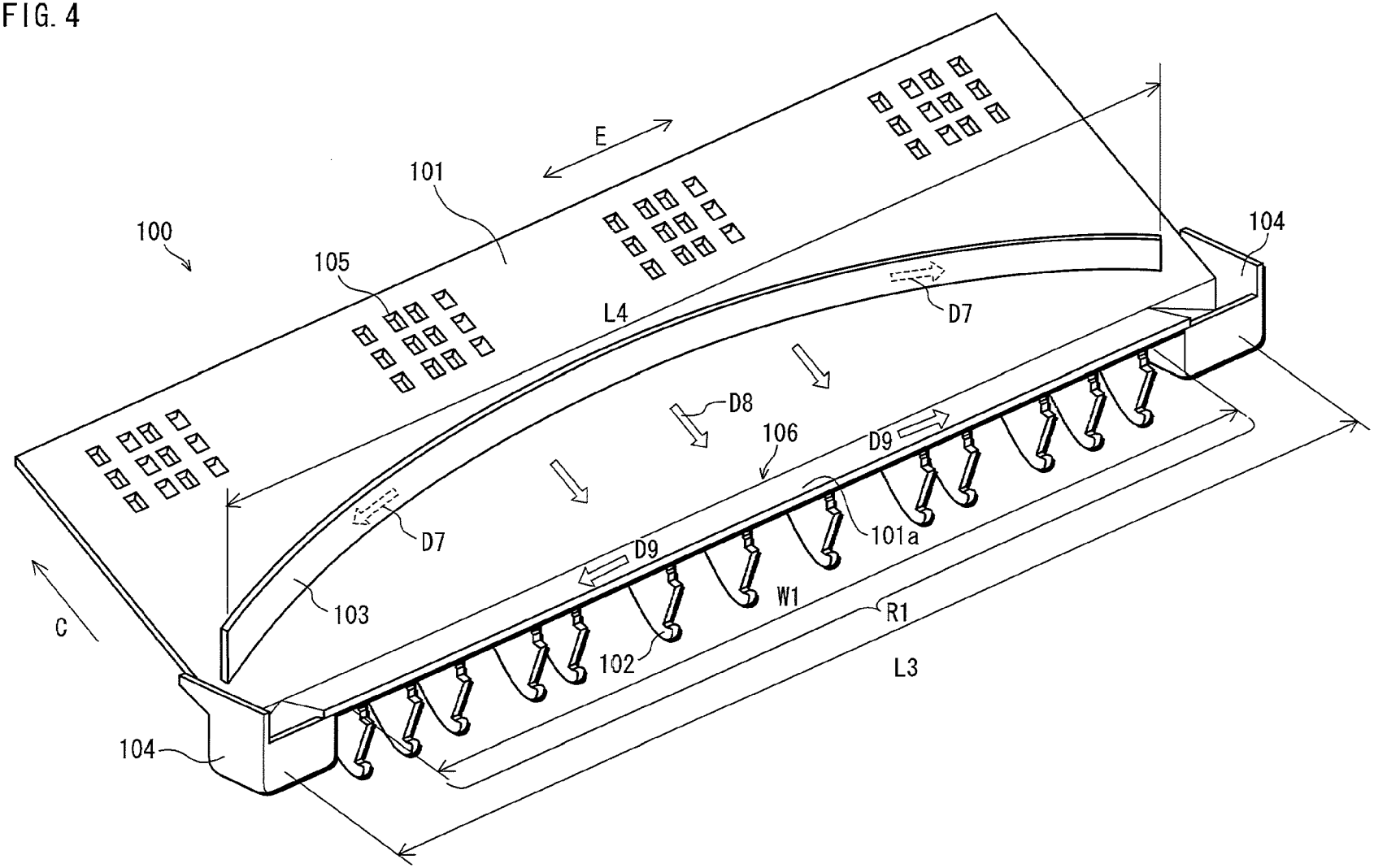
FIG. 4 is a perspective view illustrating an upper paper discharge guide provided to a printer pertaining to embodiment 2.

FIG. 4 is a perspective view illustrating an upper paper discharge guide 100 in the present embodiment.

As illustrated in FIG. 4, the upper paper discharge guide 100 includes: a guide main body 101; multiple guide ribs 102; a water droplet guide rib 103; and a pair of water droplet collection containers 104.

In the present embodiment, the guide main body 101 is composed of a member having the shape of a flat plate. Note that, due to the guide main body 101 being composed of such a flat-shaped member in the present embodiment, the guide ribs 102 can be adjusted such that bottom end surfaces of the guide ribs 102 are level with respect to each other by simply equalizing the amount by which the guide ribs 102 protrude from the guide main body 101. Such adjustment is similar to that performed according to conventional technology.

The water droplet guide rib 103 has a curved shape such that (i) a center portion thereof in the width direction E protrudes towards the downstream area of the guide main body 101 in the sheet discharge direction C and (ii) both end portions thereof in the width direction E extend towards the water droplet collection containers 104 provided to an area of the guide main body 101 lying relatively upstream in the sheet discharge direction C (referred to hereinafter as an "upstream area"). Further, a length L4 of the water droplet guide rib 103 in the width direction E is set so as to be equal to or greater than the maximum width W1 of the sheet passing region R1 and so as to be smaller than a length L3 of the guide main body 101. As such, the water droplet guide rib 103 extends so as to overlap the entire sheet passing region R1 in the width direction E.

Figure 5:
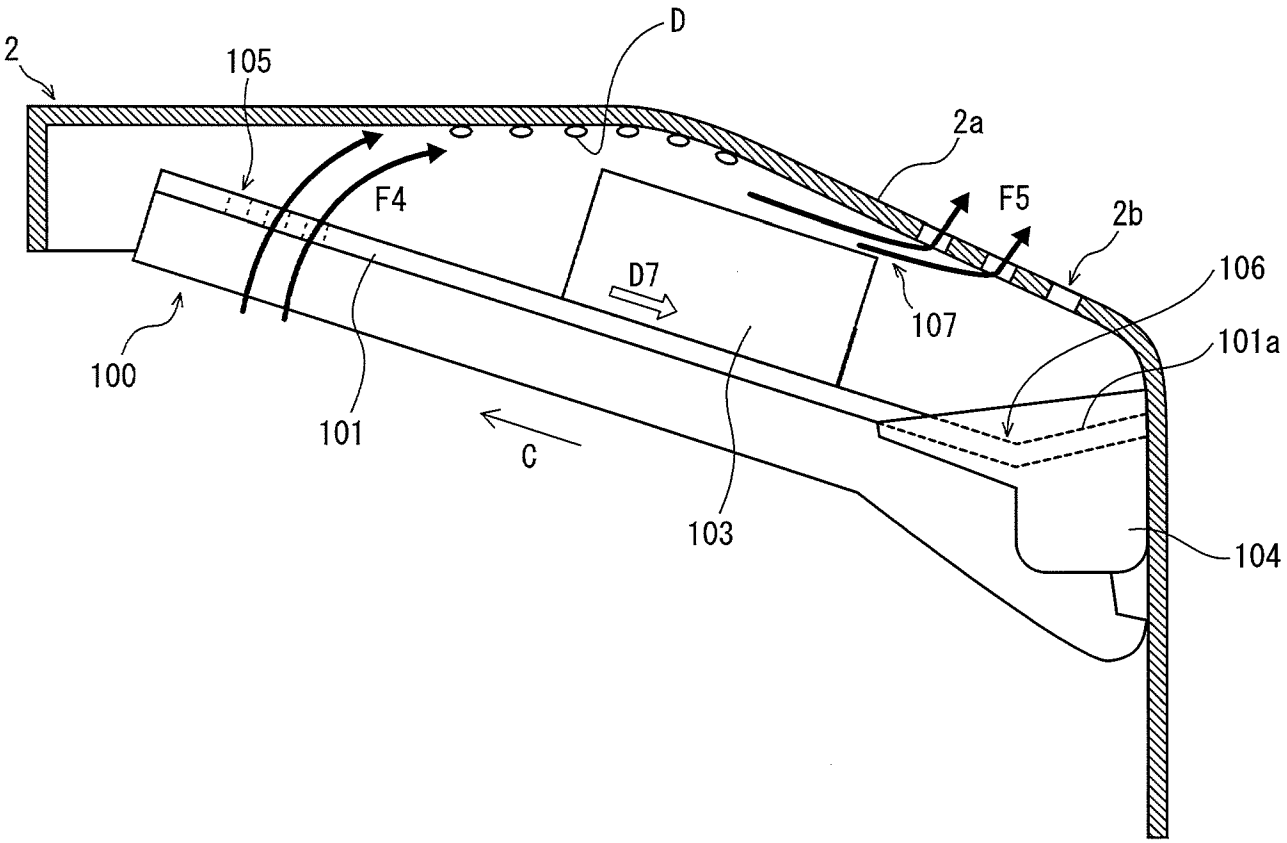
FIG. 5 is a schematical side view illustrating a state where the upper paper discharge guide is attached to an outer cover.

Here, it should be noted, when attached to the outer cover 2*a*, the guide main body 101 is arranged in an inclined state similar as in embodiment 1 where the upstream area of the guide main body 101 in the sheet discharge direction C is lower than the downstream area of the guide main body 101 in the sheet discharge direction C, as illustrated in FIG. 5 By the guide main body 101 being arranged in the inclined state as described above, an upper surface of the guide main body 101 forms an inclined surface whose height decreases as approaching the upstream area of the guide main body 101. In contrast, the guide main body 101, in the width direction E, is not inclined relative to the horizontal direction.

In addition, a gutter 106 having a V-shaped cross section is formed in the guide main body 101 by an upstream-direction end portion of the guide main body 101 in the sheet discharge direction C (hereinafter referred to as an "upstream end portion 101*a*") being bent slightly upwards.

Further, a predetermined interspace is formed between the water droplet guide rib 103 and the outer cover 2*a*. Due to this, water vapor having passed through a vent 105 provided to the guide main body 101 (as indicated by the arrow F4 in FIG. 5) is discharged to the outside of the printer 1 from the outlet 2*b* of the outer cover 2*a* after passing through a discharge duct 107 between the guide main body 101 and the outer cover 2*a* (as indicated by the arrow F5 in FIG. 5).

In addition, in the present embodiment, the upstream end portion 101*a* of the guide main body 101 is put in contact with the inner surface of the outer cover 2*a*. By putting the upstream end portion 101*a* in contact with the inner surface of the outer cover 2*a*, water droplets flowing along the inner surface of the outer cover 2*a* are prevented from dropping onto the sheet passing region of the sheet refeeding path 73.

In addition, in the present embodiment, water droplets (indicated by the symbols D in FIG. 4) that are formed by water vapor condensing at the inner surface of the outer cover 2*a* and that drop onto an area, of the guide main body 101, lying further downstream in the sheet discharge direction C than the water droplet guide rib 103 move along the water droplet guide rib 103 (as indicated by the arrow D7 in FIG. 4) before being collected by the water droplet collection containers 104. On the other hand, water droplets that drop onto an area, of the guide main body 101, lying further upstream in the sheet discharge direction C than the water droplet guide rib 103 move along the inclined surface of the guide main body 101 towards the gutter 106 (as indicated by the arrow D8 in FIG. 4) and are guided towards the water droplet collection containers 104 by the gutter 106 (as indicated by the arrow D9 in FIG. 4) before being collected by the water droplet collection containers 104.

In the present embodiment, the water droplet collection containers 104 for collecting water droplets generated as a result of condensation of water vapor are disposed to the outside of the maximum sheet passing region of the sheet S, similar as in embodiment 1. As such, the same effects as those achieved by embodiment 1 are achieved by embodiment 2.

Embodiment 3

Embodiment 3 differs from embodiment 2 in that a guide main body in embodiment 3 is provided with a plurality of water droplet guide ribs each having an arched, elongated shape.

Since the rest of the constituent elements are basically similar to the corresponding constituent elements in embodiment 2, such constituent elements are indicated by using the same reference signs as in embodiment 2 and description of such constituent elements are omitted in the following.

Figure 6:
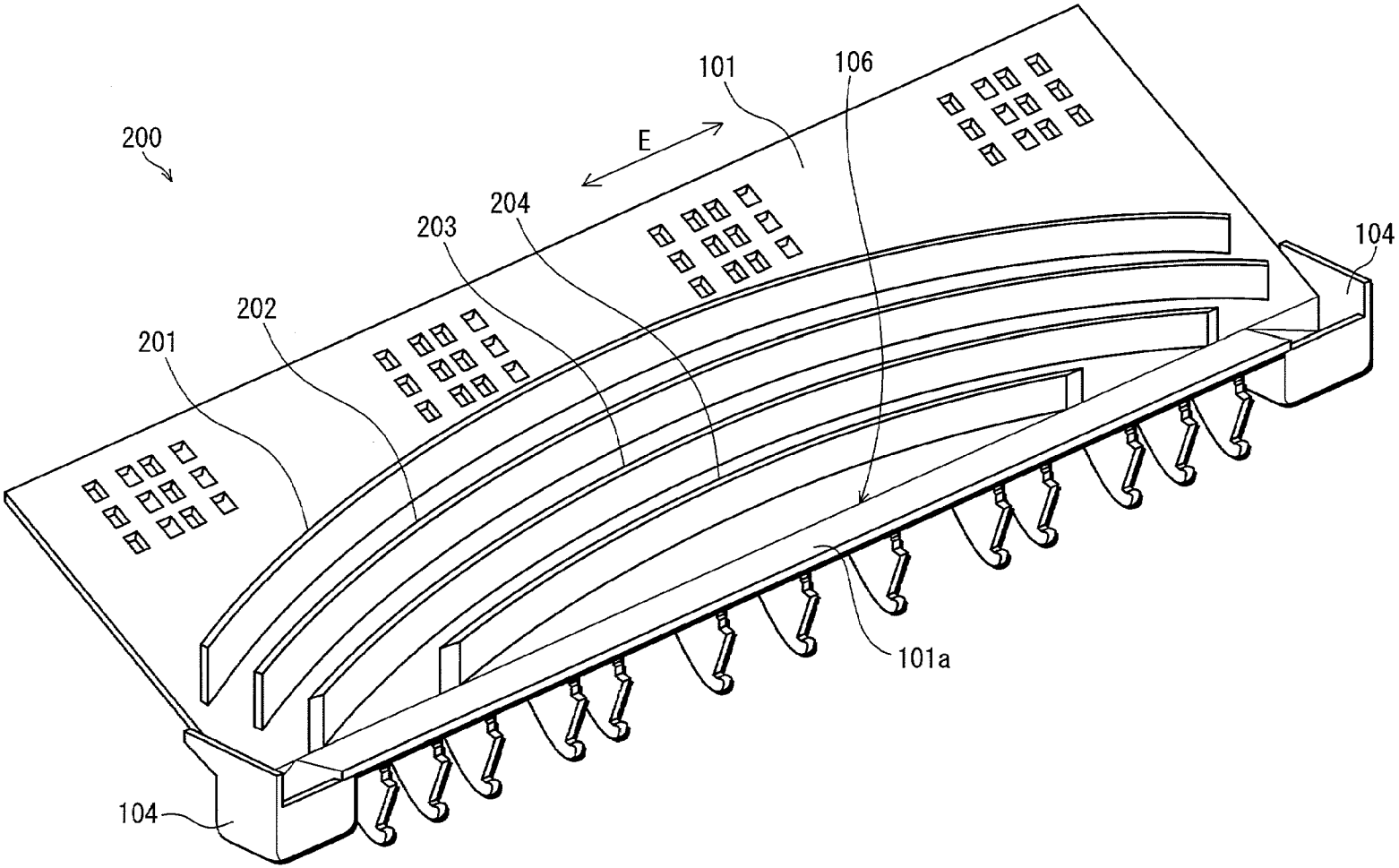
FIG. 6 is a perspective view illustrating an upper paper discharge guide provided to a printer pertaining to embodiment 3.

FIG. 6 is a perspective view illustrating an upper paper discharge guide 200 in the present embodiment.

As illustrated in FIG. 6, multiple water droplet guide ribs 201 through 204 are disposed so as to stand on the upper surface of the guide main body 101 of the upper paper discharge guide 200. The water droplet guide ribs 201 through 204 each have an elongated shape.

In the following, explanation is provided of the reason as to why the multiple water droplet guide ribs 201 through 204 are provided to the upper paper discharge guide 200.

The gutter 106 provided to the guide main body 101 is not inclined relative to the horizontal direction. Due to this, the gutter 106 accumulates therein a certain amount of water droplets. Basically, when water droplets are accumulated within the gutter 106, the accumulated water droplets flow towards the water droplet collection containers 104, which are lower in height than the gutter 106. Therefore, there is no risk of the water droplets accumulated in the gutter 106 dropping from the gutter 106 while printing is performed. However, when the outer cover 2*a* is opened for jam removal or inspection as described above, there is a risk of the water droplets accumulated in the gutter 106 dropping. In view of such a risk, in the present embodiment, the multiple water droplet guide ribs 201 through 204 are provided on the guide main body 101 so as to suppress water droplets from accumulating inside the gutter 106.

Here, it should be noted that the number of water droplet guide ribs that can be provided on the guide main body 101 is not limited to four as illustrated in FIG. 6. Alternatively, two, three, or more than five water droplet guide ribs may be provided on the guide main body 101.

[Modifications]

In the above, description has been provided of the present invention while referring to several embodiments thereof. However, the present invention should not be construed as being limited to such embodiments, and rather, such modifications as presented in the following may be made without departing from the spirit and scope of the present invention.

(1) In embodiment 1, description has been provided that the guide main body 441 has an inverted V shape. The shape of the guide main body in embodiment 1, however, is not limited to this. For instance, the guide main body in embodiment 1 may have a curved shape such that a center portion thereof in the width direction E protrudes upwards.

In addition, in embodiment 1, two plate-like portions P1 and P2 are combined so as to form the guide main body 441 having an inverted V shape. The structure of the guide main body in embodiment 1, however, is not limited to this. For instance, the guide main body in embodiment 1 may be formed so as to have an inverted V shape by, for instance, using a relatively-thick plate-like member and by processing the plate-like member such that a cross section of an upper surface thereof in the width direction E exhibits an inverted V shape.

Further, when the guide main body in embodiment 1 has an inverted V shape or a curved shape as described above, a peak (a portion having the maximum height) of the guide main body need not be located along the center portion of the guide main body in the width direction E and may be offset from the center portion. Nevertheless, when the pair of water droplet collection containers in embodiment 1 are provided with the same size, it is desirable that the peak (the portion having the maximum height) of the guide main body be located along the center portion of the guide main body in the width direction E so as to ensure that a similar amount of water droplets is collected by each of the water droplet collection containers.

(2) In embodiments 2 and 3, description has been provided of structures where the guide main body 101, in the width direction E, is not inclined relative to the horizontal direction when attached to the outer cover 2*a*. The arrangement of the guide main body with respect to the outer cover 2*a* in embodiments 2 and 3, however, is not limited to this.

For instance, in a case where it is difficult to provide a water droplet collection container to a specific one of the end portions of the guide main body in the width direction E due to lack of space or the like, the guide main body, in the width direction E, may be inclined relative to the horizontal direction, and further, a water droplet collection container may be provided only to the other one of the end portions of the guide main body, which has become lower in height compared to the specific one of the end portions due to the inclination of the guide main body.

(3) In embodiments 2 and 3, description has been provided of structures where one or more water droplet guide ribs each having an arched shape (a curved shape) is provided to the guide main body 101. The shape of the water droplet guide ribs in embodiments 2 and 3, however, is not limited to this. That is, one or more water droplet guide ribs exhibiting an inverted V shape in top view (i.e., one or more water droplet guide ribs each composed of two linear segments in top view) may be provided to the guide main body in embodiments 2 and 3.

Furthermore, the shape, the arrangement, and the number of water droplet guide ribs in the present invention may be selected as appropriate as long as the one or more water droplet guide ribs are capable of guiding water droplets having dropped onto the guide main body towards the water droplet collection containers.

Taking this into consideration, for instance, a water droplet guide rib having an arched shape may be provided to the guide main body 441 in embodiment 1, which has an inverted V shape as described above.

(4) In the embodiments, description has been provided of structures where the water droplet collection containers 444 (104) and the guide main body 441 (101) are integrally molded. The structural relation between the water droplet collection containers and the guide main body in the embodiments, however, is not limited to this.

For instance, the water droplet collection containers may be separately formed and may be later attached to the guide main body. In addition, the separately formed water droplet collection containers may be disposed at a predetermined distance from the guide main body given that it is ensured that water droplets received and collected by the guide main body fall into or flow into such water droplet collection containers.

(5) In embodiment 1, a combination of the guide main body and the water droplet guide rib functions as the water droplet guiding member that receives water droplets dropping thereon from the inner surface of the outer cover 2*a* and that guides the water droplets received to the pair of water droplet collection containers. The structure of the water droplet guiding member according to the present invention, however, is not limited to this.

Figure 7:
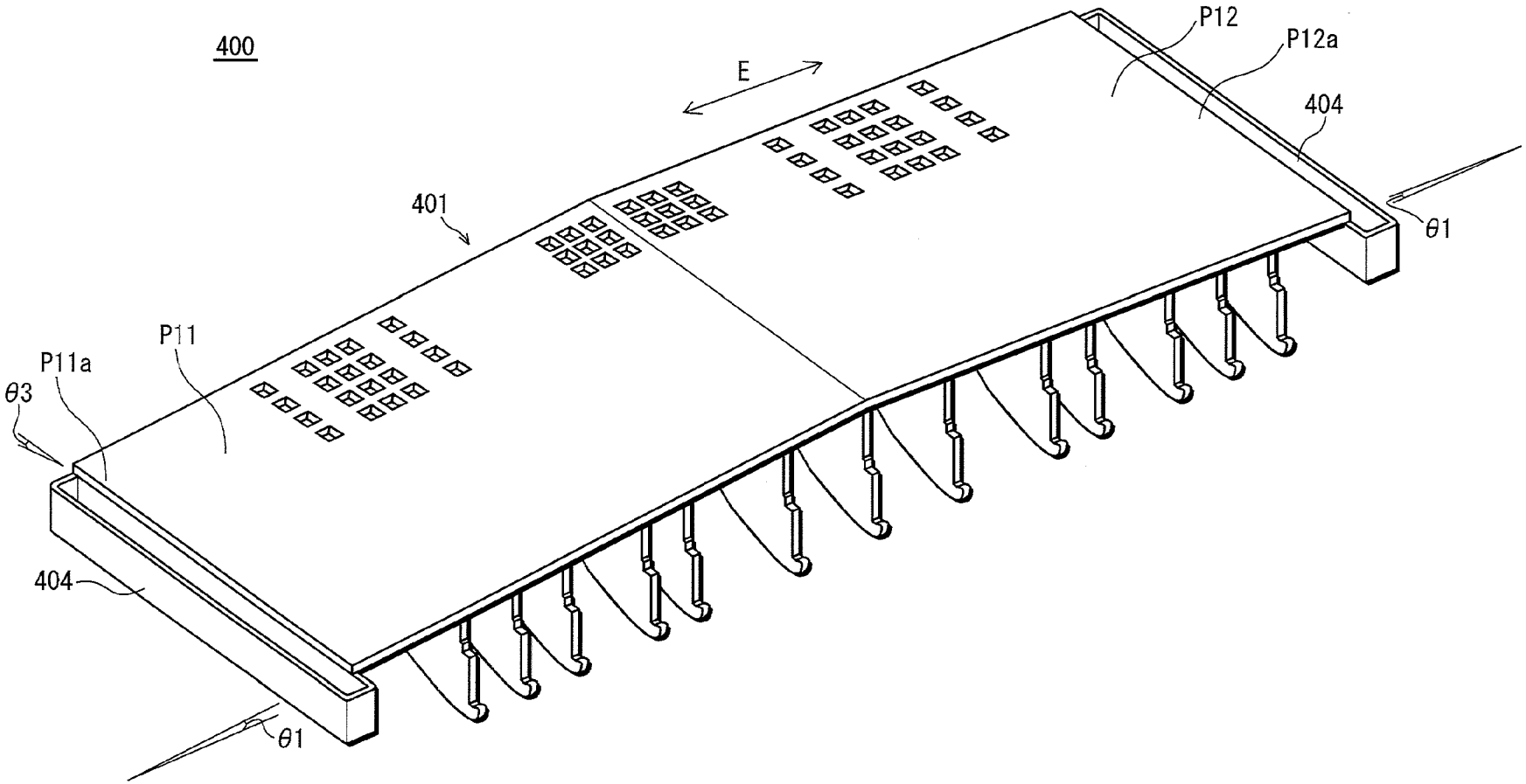
FIG. 7 is a perspective view illustrating an upper paper discharge guide provided to a printer pertaining to one modification of the present invention.

For instance, as illustrated in FIG. 7, the water droplet guiding member 400 may be composed of only a guide main body 401, or that is, the water droplet guiding member 400 need not include a water droplet guide rib or a gutter.

The guide main body 401 illustrated in FIG. 7 is composed of two plate members P11 and P12 and has an inverted V shape. Further, a water droplet collection container 404 is provided at each of ends P11*a* and P12*a* of the guide Main body 401 in the width direction E. Here, the water droplet collection containers 404 each have a size large enough to entirely overlap an edge of the corresponding one of the ends P11*a* and P12*a*. By attaching the guide main body 401 to an outer cover such that the ends P11*a* and P12*a* of the guide main body 401 in the width direction E are not inclined relative to the horizontal direction (inclination angle $\Theta 3=0°$, water droplets dropping onto the guide main body 401 are caused to move along the inclined surfaces of the plate members P11 and P12 towards the ends P11*a* and P12*a* before being collected by the water droplet collection containers 404.

(6) In the embodiments, description has been provided of structures where the mechanism for receiving and collecting the water droplets D falling from the inner surface of the outer cover 2*a* is provided to the upper discharge sheet guide 44, which constitutes the sheet discharge path 72. The manner in which the mechanism for receiving and collecting the water droplets D is to be provided in the present invention, however, is not limited to this.

For instance, a wider interspace may be provided between the outer cover and the upper discharge sheet guide of the main body unit 2, and further, a combination of a plate-like water droplet guiding member and one or more water droplet collection containers may be disposed in the interspace between the outer cover and the upper discharge sheet guide. In such a case, the plate-like water droplet guiding member is provided for the sole purpose of receiving and collecting the water droplets D dropping from the outer cover. Here, it should be noted that, as already described in (4) above, the one or more water droplet collection containers need not be attached to the water droplet guiding member. As such, an increase in the height of the main body unit 2 can be suppressed even in the above described case by disposing the one or more water droplet collection containers each at a side of the upper discharge sheet guide instead of providing the one or more water droplet collection containers to the water droplet guiding member.

(7) In embodiment 1, description has been provided of a structure where the upper end of the water droplet guide rib 443 is put into contact with the inner surface of the outer cover 2*a*. The structure applicable to embodiment 1 for preventing water droplets having attached to the inner surface of the outer cover 2*a* from flowing towards the bottom end of the outer cover 2*a*, however, is not limited to this.

That is, any structure is sufficient provided that water droplets having attached to the inner surface of the outer cover 2*a* are prevented from flowing towards the bottom end of the outer cover 2*a*. For instance, a rib regulating the movement of water droplets may be provided to the inner surface of the outer cover 2*a*. When employing such a structure, it is further desirable that the rib also function as a guide for guiding water vapor to the outlet 2*b*.

(8) In embodiment 1, the guiding path 445 is formed at a portion of the guide main body 441 between the water droplet guide rib 443 and each of the water droplet collection containers 444. The structure applicable to embodiment 1 for ensuring that water droplets are guided with certainty from the guide main body 441 to the water droplet collection containers 444, however, is not limited to this. That is, the guiding paths 445 need not be formed.

For instance, water droplets can be guided to the water droplet collection containers 444 with certainty by extending both ends of the water droplet guide rib 443 so as to reach the water droplet collection containers 444. Alternatively, even if not extending both ends of the water droplet guide rib 443 in such a manner, water droplets can be guided to the water droplet collection containers 444 with a high degree of certainty by appropriately adjusting the inclination angles Θ1 and Θ2 of the guide main body 441. Nevertheless, it should be noted that problems such as the formation of creases in the sheet S and the decrease in quality of an image printed on the sheet S do not occur even if water droplets were to fall from between the water droplet guide rib 443 and the water droplet collection containers 444 as long as the water droplet guide rib 443 is disposed so as to entirely overlap the sheet-passing region R1 in the width direction E. This is since, when the water droplet guide rib 443 entirely overlaps the sheet-passing region R1 in the width direction E, water droplets falling from between the water droplet guide rib 443 and the water droplet collection containers 444 falls on the sheet non-passing regions of the sheet S.

(9) In embodiment 2, description has been provided of a structure where the upstream end portion 101*a* of the guide main body 101 is put into contact with the inner surface of the outer cover 2*a*. The structure applicable to embodiment 2 for preventing water droplets having attached to the inner surface of the outer cover 2*a* from flowing towards the bottom end of the outer cover 2*a*, however, is not limited to this.

That is, similar as in (6) above, any structure is applicable provided that water droplets having attached to the inner surface of the outer cover 2*a* are prevented from flowing towards the bottom end of the outer cover 2*a*. For instance, a rib regulating the movement of water droplets may be provided to the inner surface of the outer cover 2*a*.

(10) In embodiments 2 and 3, description has been provided of structures where the gutter 106 provided to the guide main body 101, in a longitudinal direction thereof, is not inclined relative to the horizontal direction. The arrangement of the gutter 106 with respect to the guide main body 101 in embodiments 2 and 3, however, is not limited to this.

For instance, the gutter 106 may be provided with an inverted V shape such that the height of the gutter 106 decreases as approaching the water droplet collection containers 104 provided at both ends of the gutter 106 in the longitudinal direction from the center of the gutter 106 in the longitudinal direction. When the gutter 106 is inclined relative to the horizontal direction in such a manner, water droplets in the gutter 106 are caused to move due to the inclination before being accumulated in the gutter 106. As such, water droplets are suppressed from accumulating inside the gutter 106. This reduction in the amount of water droplets accumulating inside the gutter 106 leads to an increase in the speed at which water droplets inside the gutter 106 naturally evaporate. As such, the risk is reduced of the water droplets accumulated in the gutter 106 falling when the outer cover 2*a* is opened in the case of jam removal or inspection.

Figure 8:
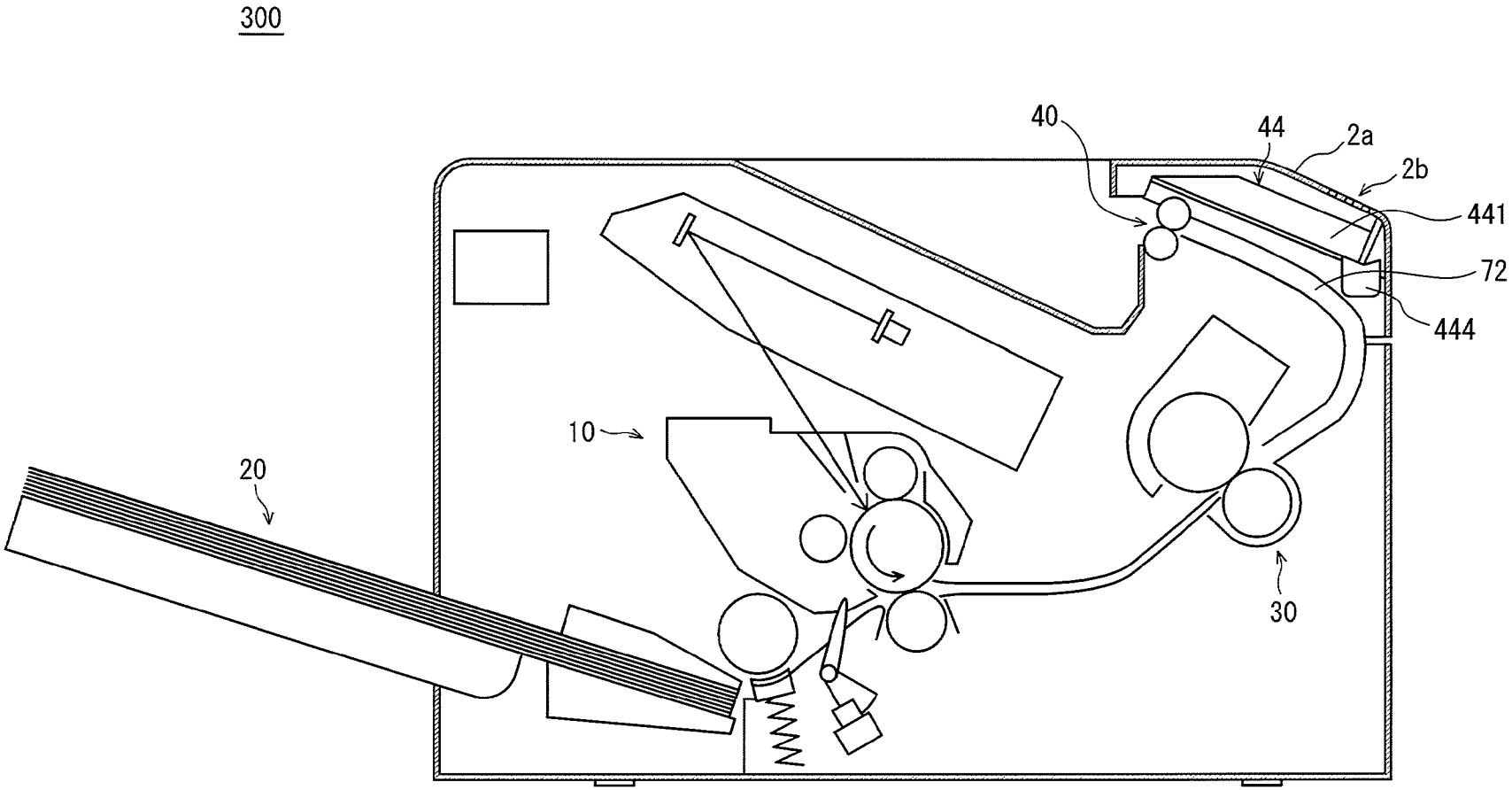
FIG. 8 illustrates an overall structure of a printer pertaining to another modification of the present invention.

(11) In the embodiments, description has been provided of the printer 1 including the duplex printing unit 3, which is attached to the main body unit 2. The present invention, however, is not limited to this. For instance, the present invention is also applicable to a printer in which a duplex printing unit option is not attached to a main body unit, one example of which is a printer 300 illustrated in FIG. 8.

(12) In the embodiments, description has been provided while taking a monochrome copier as one example of the image forming apparatus pertaining to the present invention. The present invention, however, is not limited to this. That is, the present invention is applicable to any device including a fixing unit, such as a tandem-type color copier, a tandem-type color printer, a monochrome printer, and a facsimile device.

Furthermore, the present invention may be any possible combination of the above-described embodiments and modifications.

<Conclusion>

The description provided in each of the embodiments and the modifications above illustrates an aspect of the present invention that solves the technical problems presented in the Description of Related Art section of the present disclosure. The following summarizes various aspects of the present invention disclosed or deemed as disclosed through the embodiments and the modifications.

(1) One aspect of the present invention is an image forming apparatus comprising: a fixing unit comprising a heating rotational body, and configured to perform heat-fixing by putting a sheet having an unfixed-image formed thereon in contact with the heating rotational body; and a mechanism comprising a plate-like water droplet guiding member and a condensation collection container, and configured to receive water droplets at an upper surface of the water droplet guiding member, guide the water droplets towards the condensation collection container, and collect the water droplets at the condensation collection container, the water droplets generated above the fixing unit by condensation of water vapor that rises from the sheet during the heat-fixing and falling therefrom, wherein when viewing the image forming apparatus from above in a vertical direction, the condensation collection container is disposed outside a sheet passing region in a sheet width direction, the sheet passing region being a region that the sheet passes when being conveyed and the sheet width direction being perpendicular to a direction in which the sheet is conveyed.

(2) In the image forming apparatus according to (1), the mechanism may comprise, as the condensation collection container, one condensation collection container disposed at one side of the sheet passing region in the sheet width direction, the upper surface of the water droplet guiding member may comprise a continuous inclined surface or a continuous curved surface, and the upper surface of the water droplet guiding member may decrease in height as approaching the one condensation collection container.

(3) In the image forming apparatus according to (1), the mechanism may comprise, as the condensation collection container, two condensation collection containers each disposed at a different side of the sheet passing region in the sheet width direction, a cross section, in a direction perpendicular to the direction in which the sheet is conveyed, of the upper surface of the water droplet guiding member may exhibit an inverted V shape or a curved shape with an upward protrusion, and the upper surface of the water droplet guiding member may decrease in height as approaching each of the two condensation collection containers.

(4) In the image forming apparatus according to (1), the mechanism may further comprise one or more guiding ribs that are disposed so as to stand on the upper surface of the water droplet guiding member, the one or more guiding ribs each having an elongated shape and configured to guide the water droplets received by the upper surface of the water droplet guiding member towards the condensation collection container.

(5) In the image forming apparatus according to (4), when viewing the image forming apparatus from above in the vertical direction, the one or more guiding ribs may each have a curved shape.

(6) In the image forming apparatus according to (4), the water droplet guiding member may be disposed in the image forming apparatus so as to be inclined such that, among first and second end portions of the upper surface of the water droplet guiding member in the direction in which the sheet is conveyed, the first end portion is greater in height than the second end portion, on the upper surface of the water droplet guiding member, a vent configured to let the water vapor rising from the fixing unit to pass therethrough may be formed, the vent being closer to the first end portion than the second end portion, and on the upper surface of the water droplet guiding member, the one or more guiding ribs may be disposed so as to be closer to the second end portion than the vent.

(7) The image forming apparatus according to (6) may further comprise: a housing accommodating therein the fixing unit and the mechanism, and comprising a portion that is above the mechanism and covers the water droplet guiding member; and a support shaft attached to an area of the housing in close proximity to the second end portion of the upper surface of the water droplet guiding member and extending along the sheet width direction, the support shaft configured to rotatably support the water droplet guiding member and the portion of the housing covering the water droplet guiding member, wherein the portion of the housing covering the water droplet guiding member may be openable/closable about the support shaft with respect to other portions of the housing, and the water droplet guiding member may open or close along with the portion of the housing covering the water droplet guiding member when the portion of the housing covering the water droplet guiding member is opened or closed.

(8) In the image forming apparatus according to (1), the water droplet guiding member may be further configured to function as a sheet guide and guides the sheet along a bottom surface side thereof.

(9) The image forming apparatus according to (1) may further comprise: a housing accommodating therein the fixing unit and the mechanism, and comprising an outer cover that is above the mechanism and covers the water droplet guiding member; and a discharge duct, wherein the water droplet guiding member may be disposed in the housing so as to be inclined such that, among first and second end portions of the upper surface of the water droplet guiding member in the direction in which the sheet is conveyed, the first end portion is greater in height than the second end portion, on the upper surface of the water droplet guiding member, a vent configured to let the water vapor rising from the fixing unit to pass therethrough may be formed, the vent being closer to the first end portion than the second end portion, a part of an inner surface of the discharge duct may be formed by a part of the upper surface of the water droplet guiding member and a part of a bottom surface of the outer cover, the parts being located further downstream than the vent in a direction in which the water vapor rising from the fixing unit moves in the housing, and the mechanism may collect water droplets generated at the bottom surface of the outer cover by the condensation of the water vapor rising from the fixing unit.

(10) In the image forming apparatus according to (9), the discharge duct may comprise an outlet disposed at an area of the outer cover above the second end portion of the upper surface of the water droplet guiding member.

(11) In the image forming apparatus according to (9), the water droplet guiding member may be further configured to function as a sheet guide and may guide the sheet along a bottom surface side thereof.

(12) The image forming apparatus according to (9) may further comprise a support shaft attached to an area of the housing in close proximity to the second end portion of the upper surface of the water droplet guiding member and extending along the sheet width direction, the support shaft configured to rotatably support the water droplet guiding member and the portion of the housing covering the water droplet guiding member, wherein the outer cover may be openable/closable about the support shaft with respect to the rest of the housing, and the water droplet guiding member may open or close along with the outer cover when the outer cover is opened or closed.

According to the image forming apparatus pertaining to the present invention, various aspects of which are presented in above, the water droplet collection container that collects water droplets generated by condensation of water vapor is disposed outside the sheet passing region in the sheet width direction. As such, water droplets are prevented from dropping onto a sheet even when overflowing of water droplets from the water droplet collection container occurs.

Due to being provided with such a structure, the image forming apparatus pertaining to the present invention prevents problems such as the formation of creases in the sheet and the decrease in quality of an image printed on the sheet from occurring.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a fixing unit comprising a heating rotational body, and configured to perform heat-fixing by putting a sheet having an unfixed-image formed thereon in contact with the heating rotational body; and a mechanism comprising a plate-like water droplet guiding member and a condensation collection container, and configured to receive water droplets at an upper surface of the water droplet guiding member, guide the water droplets towards the condensation collection container, and collect the water droplets at the condensation collection container, the water droplets generated above the fixing unit by condensation of water vapor that rises from the sheet during the heat-fixing and falling therefrom, wherein when viewing the image forming apparatus from above in a vertical direction, the condensation collection container is disposed outside a sheet passing region in a sheet width direction, the sheet passing region being a region that the sheet passes when being conveyed and the sheet width direction being perpendicular to a direction in which the sheet is conveyed.

2. The image forming apparatus of claim 1, wherein the mechanism comprises, as the condensation collection container, one condensation collection container disposed at one side of the sheet passing region in the sheet width direction, the upper surface of the water droplet guiding member comprises a continuous inclined surface or a continuous curved surface, and the upper surface of the water droplet guiding member decreases in height as approaching the one condensation collection container.

3. The image forming apparatus of claim 1, wherein the mechanism comprises, as the condensation collection container, two condensation collection containers each disposed at a different side of the sheet passing region in the sheet width direction, a cross section, in a direction perpendicular to the direction in which the sheet is conveyed, of the upper surface of the water droplet guiding member exhibits an inverted V shape or a curved shape with an upward protrusion, and the upper surface of the water droplet guiding member decreases in height as approaching each of the two condensation collection containers.

4. The image forming apparatus of claim 1, wherein the mechanism further comprises one or more guiding ribs that are disposed so as to stand on the upper surface of the water droplet guiding member, the one or more guiding ribs each having an elongated shape and configured to guide the water droplets received by the upper surface of the water droplet guiding member towards the condensation collection container.

5. The image forming apparatus of claim 4, wherein when viewing the image forming apparatus from above in the vertical direction, the one or more guiding ribs each have a curved shape.

6. The image forming apparatus of claim 4, wherein the water droplet guiding member is disposed in the image forming apparatus so as to be inclined such that, among first and second end portions of the upper surface of the water droplet guiding member in the direction in which the sheet is conveyed, the first end portion is greater in height than the second end portion, on the upper surface of the water droplet guiding member, a vent configured to let the water vapor rising from the fixing unit to pass therethrough is formed, the vent being closer to the first end portion than the second end portion, and on the upper surface of the water droplet guiding member, the one or more guiding ribs are disposed so as to be closer to the second end portion than the vent.

7. The image forming apparatus of claim 6 further comprising:

a housing accommodating therein the fixing unit and the mechanism, and comprising a portion that is above the mechanism and covers the water droplet guiding member; and a support shaft attached to an area of the housing in close proximity to the second end portion of the upper surface of the water droplet guiding member and extending along the sheet width direction, the support shaft configured to rotatably support the water droplet guiding member and the portion of the housing covering the water droplet guiding member, wherein the portion of the housing covering the water droplet guiding member is openable/closable about the support shaft with respect to other portions of the housing, and the water droplet guiding member opens or closes along with the portion of the housing covering the water droplet guiding member when the portion of the housing covering the water droplet guiding member is opened or closed.

8. The image forming apparatus of claim 1, wherein the water droplet guiding member is further configured to function as a sheet guide and guides the sheet along a bottom surface side thereof.

9. The image forming apparatus of claim 1 further comprising:

a housing accommodating therein the fixing unit and the mechanism, and comprising an outer cover that is above the mechanism and covers the water droplet guiding member; and a discharge duct, wherein the water droplet guiding member is disposed in the housing so as to be inclined such that, among first and second end portions of the upper surface of the water droplet guiding member in the direction in which the sheet is conveyed, the first end portion is greater in height than the second end portion, on the upper surface of the water droplet guiding member, a vent configured to let the water vapor rising from the fixing unit to pass therethrough is formed, the vent being closer to the first end portion than the second end portion, a part of an inner surface of the discharge duct is formed by a part of the upper surface of the water droplet guiding member and a part of a bottom surface of the outer cover, the parts being located further downstream than the vent in a direction in which the water vapor rising from the fixing unit moves in the housing, and the mechanism collects water droplets generated at the bottom surface of the outer cover by the condensation of the water vapor rising from the fixing unit.

10. The image forming apparatus of claim 9, wherein the discharge duct comprises an outlet disposed at an area of the outer cover above the second end portion of the upper surface of the water droplet guiding member.

11. The image forming apparatus of claim 9, wherein the water droplet guiding member is further configured to function as a sheet guide and guides the sheet along a bottom surface side thereof.

12. The image forming apparatus of claim 9 further comprising a support shaft attached to an area of the housing in close proximity to the second end portion of the upper surface of the water droplet guiding member and extending along the sheet width direction, the support shaft configured to rotatably support the water droplet guiding member and the portion of the housing covering the water droplet guiding member, wherein the outer cover is openable/closable about the support shaft with respect to the rest of the housing, and the water droplet guiding member opens or closes along with the outer cover when the outer cover is opened or closed.

* * * * *